US010259257B2

(12) United States Patent
Reichert et al.

(10) Patent No.: US 10,259,257 B2
(45) Date of Patent: Apr. 16, 2019

(54) REVERSIBLE DIVIDERS

(71) Applicant: CCL Label, Inc., Framingham, MA (US)

(72) Inventors: Regina Reichert, Whittier, CA (US); Summer Marker, Diamond Bar, CA (US); Alan Jameson, West Covina, CA (US); Jenifer Do, Fullerton, CA (US)

(73) Assignee: CCL Label, Inc., Framingham, MA (US)

( * ) Notice: Subject to any disclaimer, the term of this patent is extended or adjusted under 35 U.S.C. 154(b) by 82 days.

(21) Appl. No.: 15/016,378

(22) Filed: Feb. 5, 2016

(65) Prior Publication Data

US 2016/0229217 A1 Aug. 11, 2016

Related U.S. Application Data

(60) Provisional application No. 62/113,065, filed on Feb. 6, 2015.

(51) Int. Cl.
*B42F 21/02* (2006.01)
*B42F 21/12* (2006.01)
*B42F 3/00* (2006.01)

(52) U.S. Cl.
CPC ..... *B42F 21/02* (2013.01); *B42F 3/003* (2013.01); *B42F 3/006* (2013.01); *B42F 21/12* (2013.01)

(58) Field of Classification Search
CPC .. B42F 3/00; B42F 3/003; B42F 3/006; B42F 21/02; B42F 21/12
USPC ..... 402/79
See application file for complete search history.

(56) References Cited

U.S. PATENT DOCUMENTS 5,407,234 A * 4/1995 Rettker ..... B42F 21/02 283/117
5,909,979 A * 6/1999 Winzen ..... B42F 21/02 402/79
5,924,812 A * 7/1999 Goldman ..... B42F 21/02 402/79
6,089,777 A * 7/2000 Wong ..... B42F 21/04 281/39
6,409,409 B2 * 6/2002 Bauman ..... B42F 21/00 402/79
2002/0131812 A1 * 9/2002 Nakaji ..... B42F 5/00 402/79

OTHER PUBLICATIONS

Avery.com Reversible Dividers http://www.avery.com/avery/en_us/Products/Dividers/Fashion-Dividers/Reversible-Divider-Big-Floral-Design-5T_24950.htm?refchannel=c042fd03ab30a110VgnVCM1000002118140aRCRD*

* cited by examiner

*Primary Examiner* — Kyle R Grabowski
(74) *Attorney, Agent, or Firm* — McDonald Hopkins LLC

(57) ABSTRACT

A divider assembly is shown and described herein. The divider assembly may divide a stack of sheets, the divider assembly may include a body and a tab extending from the body. A first side of the body and a first side of the tab may include a cover or coating. The cover or coating may include designs or indicia. A second side of the body may include a covered portion and a non-covered portion. A second side of the tab may be non-covered. Non-covered portions may be compatible with more or different writing instruments than covered portions. The divider assembly may be reversible such that the first side or the second side may be utilized.

15 Claims, 5 Drawing Sheets

REVERSIBLE DIVIDERS

REFERENCE TO RELATED APPLICATIONS

The present application claims priority to U.S. Provisional Application No. 62/113,065 entitled "REVERSIBLE DIVIDERS" filed on Feb. 6, 2015, which is incorporated by reference herein in its entirety.

FIELD OF INVENTION

The present disclosure generally relates to systems for organizing and indexing documents wherein the systems include dividers or tabbed dividers that are reversible. More particularly, the disclosure relates to a system of reversible dividers that are usable on multiple sides.

BACKGROUND

Dividers for organizing sheets of paper or display elements can include tabs that extend beyond the perimeter of the paper. The tabs generally include label indicia thereon to identify the divided section of the sheets of paper or display elements. Tabs have been known to be formed out of generally clear or transparent material and formed into pockets to insert a label having indicia thereon. Other known dividers have tabs made of clear, transparent or opaque material that include labels that may be attached by a pressure sensitive adhesive directly to the tab.

Dividers are often utilized in binders such as three ring binders or spiral binders and other types of folders or media assemblies. The dividers separate and visually label various sections of the sheets of paper or display elements to permit prompt access to any one of these sections.

However, the divider systems known have inherent deficiencies as there may be a limited use for the dividers and the apertures of a divider may become damaged. Further, numerous dividers may be needed for organizing sheets of paper. Therefore, there is a need for increased usability and versatility associated with dividers to allow for greater customization and user satisfaction. There is also a need for an improved divider system that increases the usability of dividers.

SUMMARY

The following presents a simplified summary of the specification to provide a basic understanding of some aspects of the specification. This summary is not an extensive overview of the specification. It is intended to neither identify key elements of the specification nor delineate any scope particular to any embodiments of the specification, or any scope of the claims. Its sole purpose is to present some concepts of the specification in a simplified form as a prelude to the more detailed description that is presented later.

A divider system is shown and described herein. The divider system may include a divider assembly for dividing a stack of sheets. The divider assembly may include a body and a tab extending from an edge of the body. The body may be comprised of a first material, such as paper. A first side of the body and a first side of the tab may include a surface comprised of an exposed portion of the first material.

A second side of the body and a second side of the tab may be covered by or coated with a second material. The second material may include indicia or design elements. The second material may have reduced, with respect to the first material, compatibility with writing utensils. The first side of the body may include a portion that is at least partially covered by the second material. The portion may include an area near a spine or near apertures of the body.

In another aspect, the divider may be inserted and attached to a binder. The divider may attach to the binder via apertures formed in the body. The binder may be a rigid or semi-rigid binder having a set of rings to which the stack of sheets and the divider may attach. The first side of the body, the second side of the body or both may be utilized for providing visual indications. In another aspect, a cover material may provide reinforcement for connection to a binder.

In one embodiment, provided is a divider assembly. The divider assembly may include a body having a tab extending from a perimeter and made of a base material. The body having a first side and an opposite second side. The first side comprising a first surface with an exposed portion of the base material wherein the exposed portion is a generally writable surface. The second side comprising a second surface. A cover material having pre-printed indicia and may cover the base material along the entire second surface of the second side. The cover material may wrap around the body and cover a portion of the base material along the first side such that the pre-printed indicia may be continuous from the second surface to the first surface. The base material may be thicker than the cover material.

In yet another embodiment, provided is a divider assembly comprising a body having a tab extending from a perimeter and made of a base material, the body having a first side and an opposite second side, the first side comprising a first surface with an exposed portion of the base material, the exposed portion displaying a design or indicia, the second side comprising a second surface. A cover material displaying a design or indicia and covering the base material along the entire second surface of a second side, the cover material covering a portion of the base material along the first side such that the design or indicia is continuous from the second surface to the first surface. The design or indicia of the cover material may be different from the design or indicia of the exposed portion of the base material. The exposed portion may be compatible to receiving writing from a utensil and the cover material may be less compatible to receive writing from a utensil than the exposed portion of the base material.

The following description and the drawings set forth certain illustrative aspects of the specification. The drawings indicate a few of various embodiments that may utilize certain aspects of this disclosure. While some improvements and novel aspects may be specifically identified, others will be apparent from the detailed description.

DESCRIPTION OF THE DRAWINGS

The accompanying drawings illustrate various systems, apparatuses, devices and methods, in which like reference characters refer to like parts throughout, and in which.

DETAILED DESCRIPTION

Figure 1:
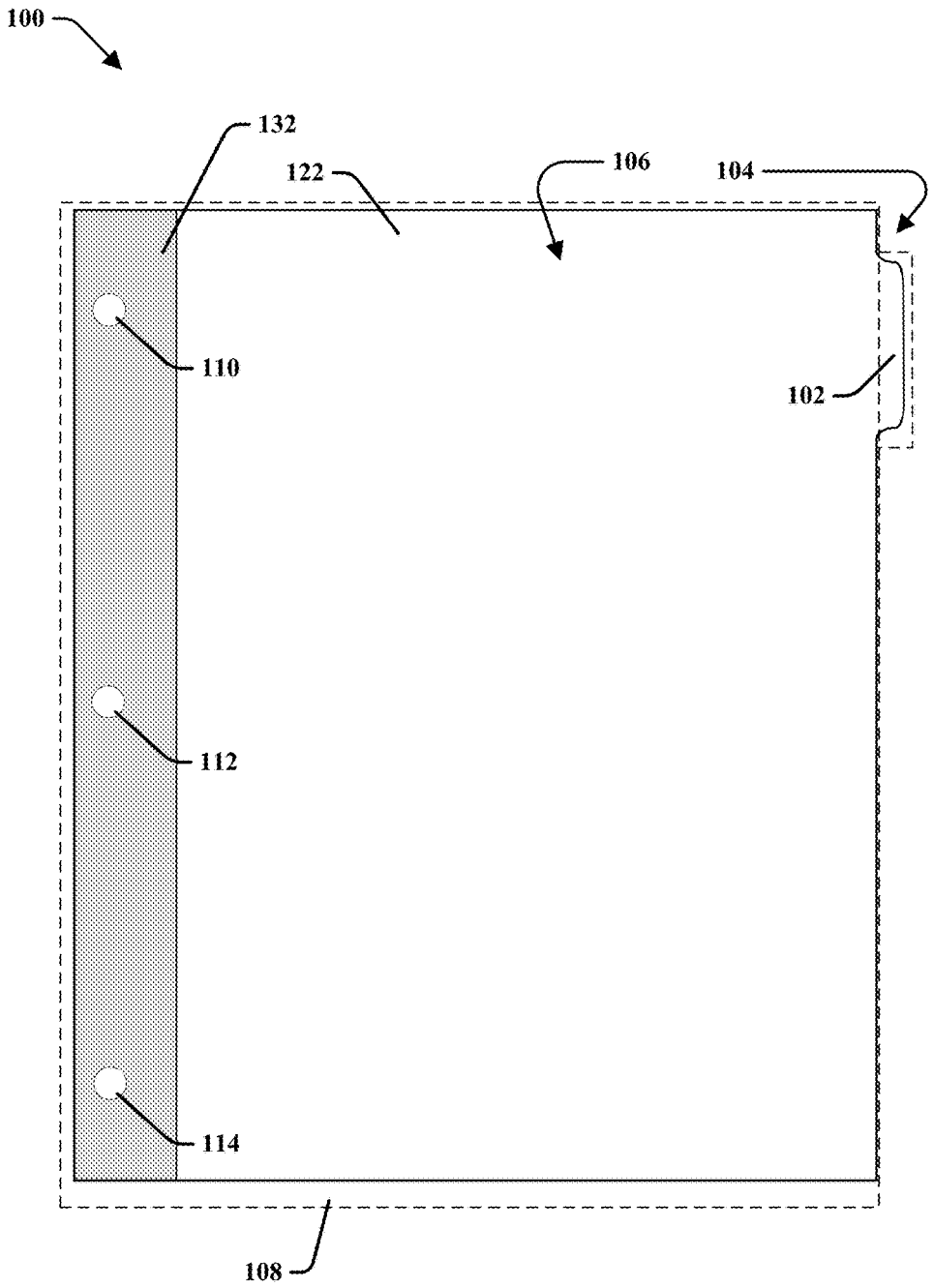
FIG. 1 is a front view of a divider in accordance with various described embodiments.

Reference will now be made in detail to embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

As used herein, the terms "tab", "tab element", "flag", "call out", "page marker", and the like are used interchangeably unless context warrants a particular distinction among such terms. For instance, the terms may refer to an element that may extend from an edge of a divider. Such elements may be of various shapes. The shapes may be generally rectangular, generally elliptical, generally triangular, irregular in shape, and the like. Accordingly, it is noted that embodiments referencing a tab are not limited by a particular type or design of the tab. As such, it is noted that appropriate modifications may be made based on a desired tab.

Further, unless context suggest otherwise, descriptions of shapes (e.g., circular, rectangular, triangular, etc.) refer to shapes meeting the definition of such shapes and general representation of such shapes. For instance, a triangular shape or generally triangular shape may include a shape that has three sides and three vertices or a shape that generally represents a triangle, such as a shape having three major sides that may or may not have straight edges, triangular like shapes with rounded vertices, and the like.

Embodiments described herein may refer to a "cover", "coating", "cover material", "coating material", or the like. A "cover" or "cover material" may refer to a film or sheet that is attached to or attachable to a surface, such as through an adhesive. The "cover material" may also refer to a material that is deposited on or may be deposited on a surface, such as paint, ink, a sprayable material, or the like. Some embodiments may refer to one of such terms and not the other for readability. Accordingly, an embodiment referring to one of such terms may also refer to other terms unless context suggests otherwise.

It is noted that while various embodiments refer to a divider or a divider system, various other systems may be utilized in the scope and spirit of embodiments described herein. As such, references to dividers and the like are understood to include various systems that may be inserted into a binder. Such systems may include, but are not limited to, folders, cover sheets, pouches (e.g., pencil cases, etc.), sleeves (e.g., plastic sleeves to which papers or other materials may be inserted), and the like. Furthermore, while divider systems are described as organizing binders, three ring binders, or the like, it is noted that the described divider systems may be applied to organize or otherwise affect location and placement of materials in various other objects or devices. For instance, dividers of this disclosure may be utilized in such items as a spiral note book, filing cabinet, ROLODEX, pronged folder, N-ring binder (where N is a number), index card box, and the like.

Divider systems of this disclosure may be of any appropriate configuration and are not limited to those shown and described herein. It should be noted that the divider systems may be adapted to divide a plurality of sheets or other display elements of any appropriate size, including, without limitation, 8.5 inches by 11 inches, 5.5 inches by 8.5 inches, A4 size, legal size or any other applicable size. Furthermore, the divider systems may be configured to be utilized with a binder of any appropriate size and construction.

It is noted that the various embodiments described herein may include other components and/or functionality. However, some components or functionality that may be apparent may not be explicitly described for the sake of brevity. Such components and functionality are considered within the scope and spirit of the various embodiments described herein.

Aspects of systems, apparatuses or processes described herein generally relate to divider systems. In an embodiment, a divider system may include a reversible divider. A first side of the divider may include an exposed portion of a base material, such as paper stock. A second side of the divider may include a covering or a coating. The covering or coating may include a cover material (e.g., glossed paper, plastic, silicon, etc.) or coating material (e.g., plastic, paint, ink, etc.). The cover material may be applied to the paper stock to cover a surface of the second side. In another aspect, a portion of the first side may be covered by the second material. The portion may be proximal to an edge of the divider nearest to one or more apertures.

In an example, a user may write on a first side of the divider (e.g., on the body and/or the tab). The user may write information such as "Algebra Homework" on the first side. The user may then organize a stack of paper or other sheets. However, if the user desires to re-use the divider or use a covered side of the divider, the user may remove the divider and flip or reverse the divider such that the covered side is viewable to the user from the front of the binder. In an aspect, the covered side of the divider may be less compatible with writing utensils, such as ink pens, graphite, lead, crayons (e.g., wax), or the like. For instance, the covered side may not readily receive graphite from a pencil. In another aspect, the covered side may comprise indicia such as graphics, printed text, or other aspects that may make user added writings difficult to read.

FIG. 1 is a front view of a divider 100 in accordance with various described embodiments. Divider 100 may be inserted or attached to a three ring binder or the like. For instance, rings (not shown) of a binder may secure at least a portion of the divider 100 via one or more apertures (e.g., apertures 110, 112, and/or 114). Divider 100 may include at least one tab 102 outwardly extending from a perimeter of a body 108. It is noted that tab 102 may be positioned along any edge of body 108. As depicted, tab 102 is positioned opposite from apertures 110, 112, and 114.

Figure 2:
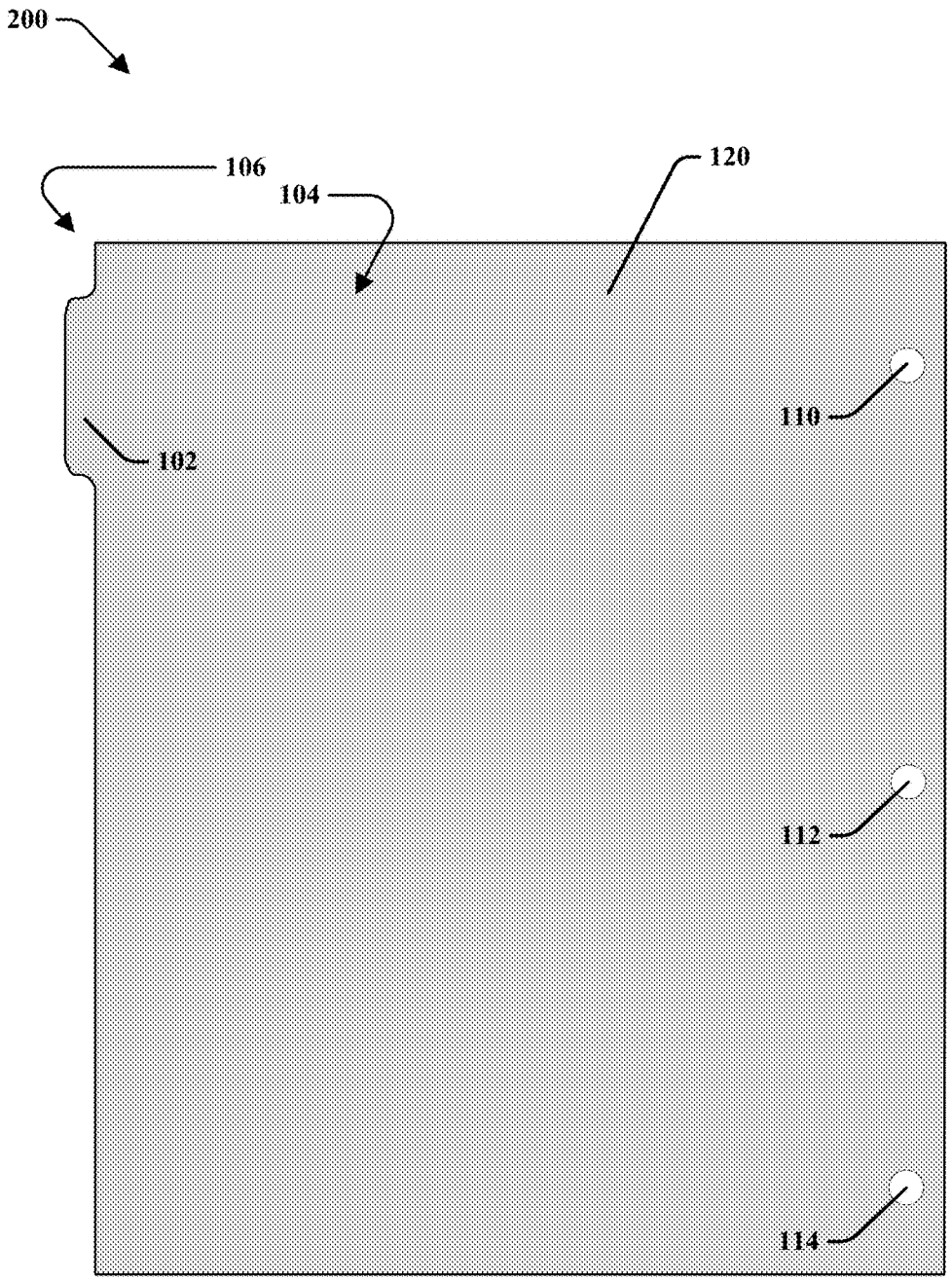
FIG. 2 is a back view of a divider in accordance with various described embodiments.

A first side 106 of divider 100 is shown in FIG. 1, while a second side 104 of divider 100 is shown in FIG. 2. In an embodiment, the first side 106 may include a covered surface 132 and a non-covered surface 122. The non-covered surface 122 may comprise an exposed portion of a base material that forms the body 108. The covered surface 132 may comprise a cover material or coating that is adhered or attached to the base material.

While non-covered surface 122 is generally described as non-covered or non-coated, it is noted that non-covered surface 122 may be covered or coated. In an aspect, non-covered surface 122 is a portion of divider 100 that is not covered by the same material that covers covered surface 132. For instance, body 108 may comprise a base material consisting of coated paper stock. Covered surface 132 may comprise a glossed or semi-glossed film that is adhered to body 108. Non-covered surface 132 may comprise an exposed portion of the base material (e.g., a portion of the coated paper stock).

FIG. 2 is a back view of divider 100 in accordance with various described embodiments. Second side 104 of divider 100 may comprise a coated or covered surface 120. The coating or cover may comprise indicia, printed information (e.g., conversion charts, measurement markings, multiplication tables, tax rates, etc.), graphical designs, solid colors, or the like. The coating or cover may comprise a plastic, paper (coated or non-coated), a polymer material such as a polypropylene material, fabric, metal, leather, ink, paint, sprayed material and the like. In an aspect, the coating or cover may be deposited and/or applied via a mechanical machine, or manually by a user.

In an embodiment, covered surface 120 and covered surface 132 may comprise a common material. For example, a film may be applied to back side 104, and may continuously wrap around to front side 106 to cover an edge 140 of the base material 124 and at least a portion of front side 106 (e.g., covered surface 132). See FIG. 3A. Alternatively, the covered surface 120 and covered surface 132 may be applied in an unwrapped configuration such that the edge 140 does not receive the cover material 126. See FIG. 3B. In at least one embodiment, covered surface 120 and covered surface 132 may comprise a common continuous design or indicia such that the design or indicia extends from covered surface 120 to covered surface 132.

Figure 3A:
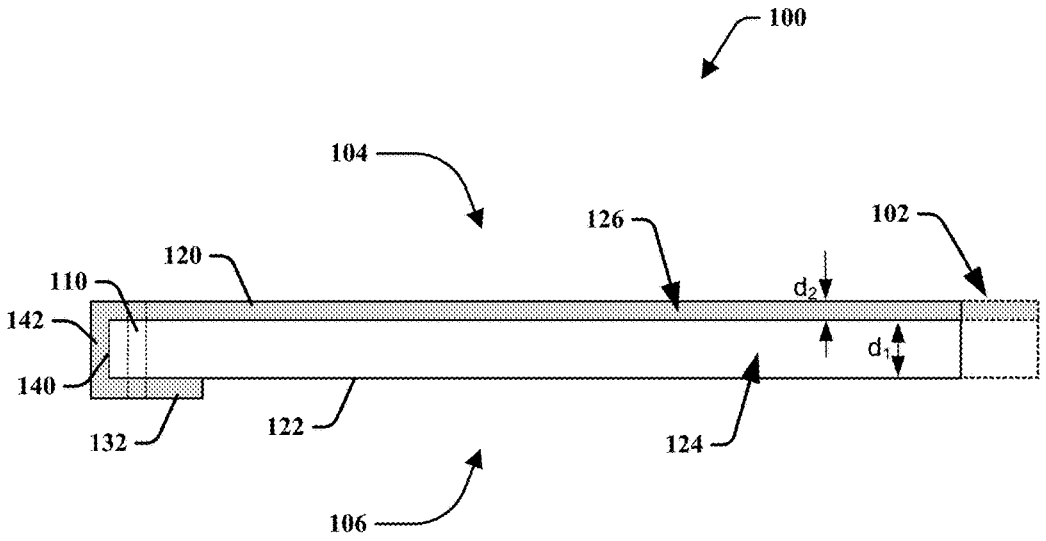
FIG. 3A is an enlarged side view of a divider with the cover material in a wrapped configuration in accordance with various described embodiments.

FIG. 3A is an enlarged side view of a divider 100 in accordance with various embodiments disclosed herein. In an embodiment, divider 100 may include a base material 124. In one or more embodiments, base material 124 may be made of any appropriate material, including, without limitation a plastic or polymer material (e.g., a polypropylene material), paper products (e.g., cardboard, coated paper, uncoated paper, laminated paper), leather, metal, fabric (e.g., felt) a composite, acrylics, or the like. In many embodiments, base material 124 is made of a material having a greater thickness, stiffness, and/or durability than paper sheets or display elements to which divider 100 is associated. Base material 124 may include clear or opaque, colored or colorless, transparent, translucent or semi-translucent material and include various combinations of the above aspects. As way of a further embodiment, base material 124 may be formed from a monolithic piece of paper.

As illustrated by FIG. 3A, the cover material 126 may be adhered to at least a portion of base material 124. In an example, cover material 126 may cover an entire surface of second side 104. In such a configuration, covered surface 120 may comprise the entire surface of side 104. In another aspect, cover material 126 may wrap around the divider 100 to continuously cover an edge 140 such that the entire edge 140 is a covered surface 142. Further the cover material 126 may continuously wrap around such that a portion of the first side 106 is covered along surface 132.

Figure 3B:
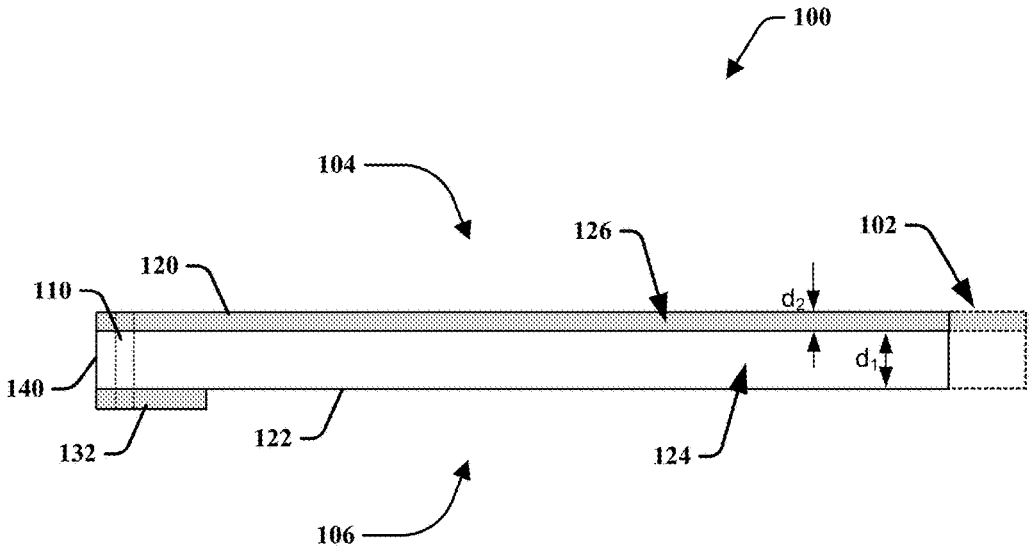
FIG. 3B is an enlarged side view of a divider with the cover material in an unwrapped configuration in accordance with various described embodiments

Alternatively, as illustrated by FIG. 3B, the cover material 126 may be adhered to at least a portion of base material 124. The cover material 126 may cover an entire surface of second side 104. In such a configuration, covered surface 120 may comprise the entire surface of side 104. Additionally, the cover material 126 may be split such that edge 140 does not receive cover material 126 thereon. Further, the cover material 126 may include designs or indicia that remain uninterrupted such that the design maintains its continuity between covered surface 120 and covered surface 132.

One or more apertures may be formed or disposed in one or more layers of divider 100. For instance, aperture 110 may be formed through cover material 126 (e.g., through covered surface 120 and/or covered surface 132) and base material 124. In some embodiments, cover material 126 may provide reinforcement for connection to a binder (e.g., strengthen apertures) or reinforcement for durability, stability, or strength of the body 108. Tab 102 may also comprise a covered portion and a non-covered portion.

As illustrated by FIGS. 3A and 3B, the base material 124 may have a first thickness dimension $d_1$ and the cover material 126 may have a second thickness dimension $d_2$. The first thickness dimension $d_1$ may be greater than the second thickness dimension $d_2$.

In an embodiment, cover material 126 may be formed separately from body material 124. In such an embodiment, cover material 126 may then be applied to body material 124 and cut to size (e.g., via a die cutting machine or the like). In another aspect, cover material 126 may be precut and then applied to body material 124.

While divider 100 has been generally described as comprising cover material 126, covered surface 120 and covered surface 132, it is noted that divider 100 may comprise other configurations. For instance, divider 100 may comprise printed surfaces or coated surfaces rather than a covered surface 120 and covered surface 132. Furthermore, divider 100 may be monolithically formed rather than having a cover. However, for sake of brevity, divider 100 has been described as having a cover.

In an example, base material 124 may be paper stock of a determined color (e.g., such as white, tan, etc.). Cover material 126 may be applied to a first surface of base material 124 at side 104. Cover material may then be wrapped around to cover the edge 140 of the base material 124 and a portion of base material 124 at side 106. Base material 124 may provide reinforcement for apertures 110, 112, and/or 114. In another aspect, base material 124 may provide reinforcement for divider 100, such that a thickness, stiffness, and/or durability of divider 100 is altered (e.g., increased).

Base material 124 may be compatible with many writing utensils or instruments, and/or printing devices. For instance, base material 124 may receive and retain contents from graphite pencils, lead pencils, dry erase markers, ball tip or ballpoint pens, felt pens, fountain pens, crayons, brushes (e.g., paint), ink jet printers, laser printers, and the like. In contrast, cover material 126 may comprise a material (e.g., plastic, metal, foil, silicon, wax, gloss material, etc.) that is less compatible with writing utensils in comparison to the base material 124. For instance, cover material 126 may not easily receive graphite, ink from ballpoint pens, or the like. However, cover material 126 may comprise a material to which an adhesive may releasably attach or connect. For example, a label having at least one adhesive side may releasably attach to cover material 126 without damaging cover material 126.

In an example, a user may write on non-covered surface 122 (e.g., body 108 and/or label 102). After the user has no need for the writing, the user may reverse divider 100 (e.g., flip and/or rotate the divider 100). The user may then utilize side 104. While the user may not be able to write on side 104, the user may utilize the inherent color and/or design of cover material 126 as a visual indicator. In another aspect, the user may apply a label on side 104, such as on tab 102 or covered surface 120.

In at least one embodiment, base material 124 may comprise a material less compatible with writing instruments than cover material 126. For example, base material 124 may comprise a plastic, metal, or the like, while cover material 126 may comprise a paper stock that is attached to the base material. In such an embodiment, a user may write more easily on cover material 126 than on base material 124.

Figure 4:
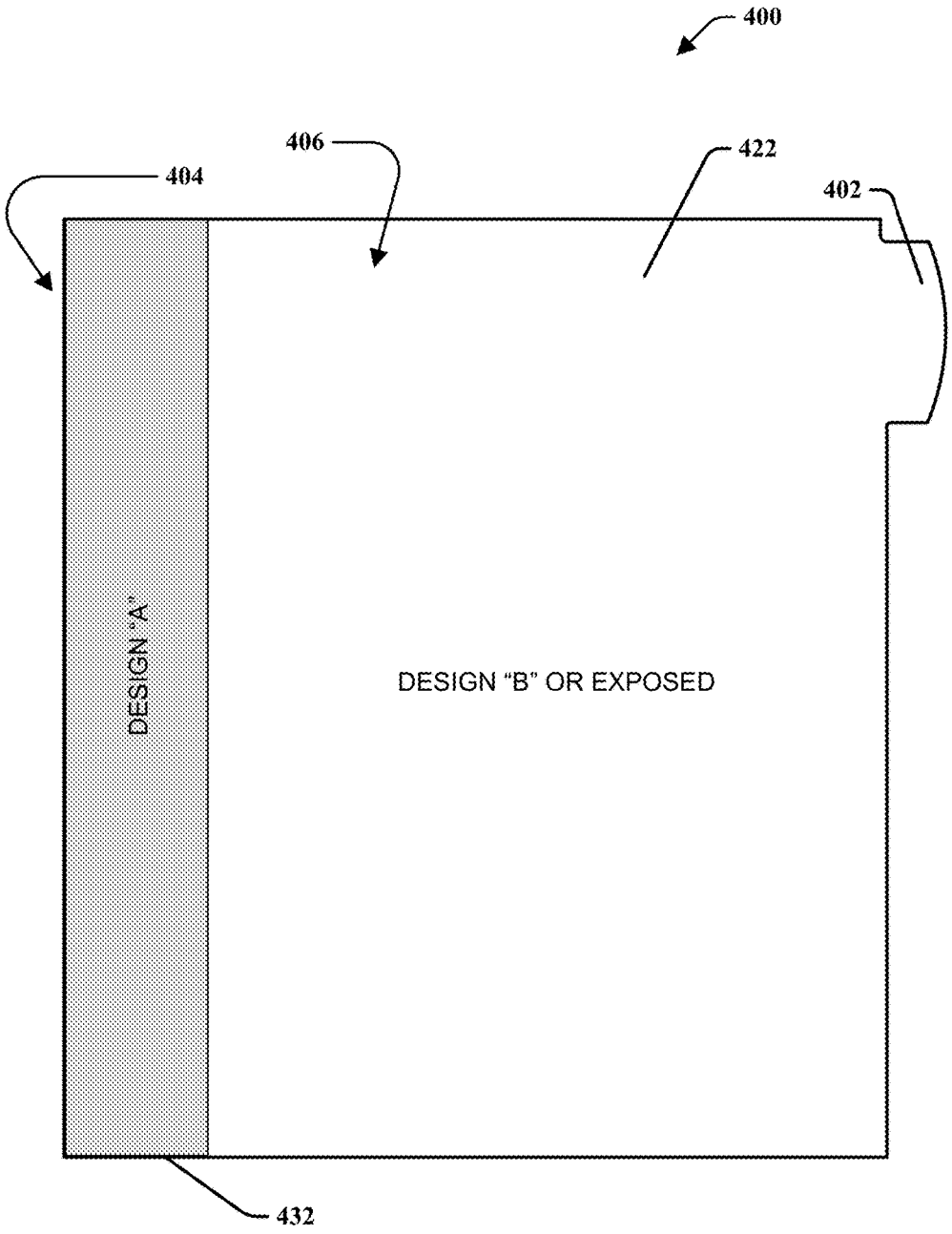
FIG. 4 is a front view of a divider having a graphical design in accordance with an embodiment of the present disclosure.
Figure 5:
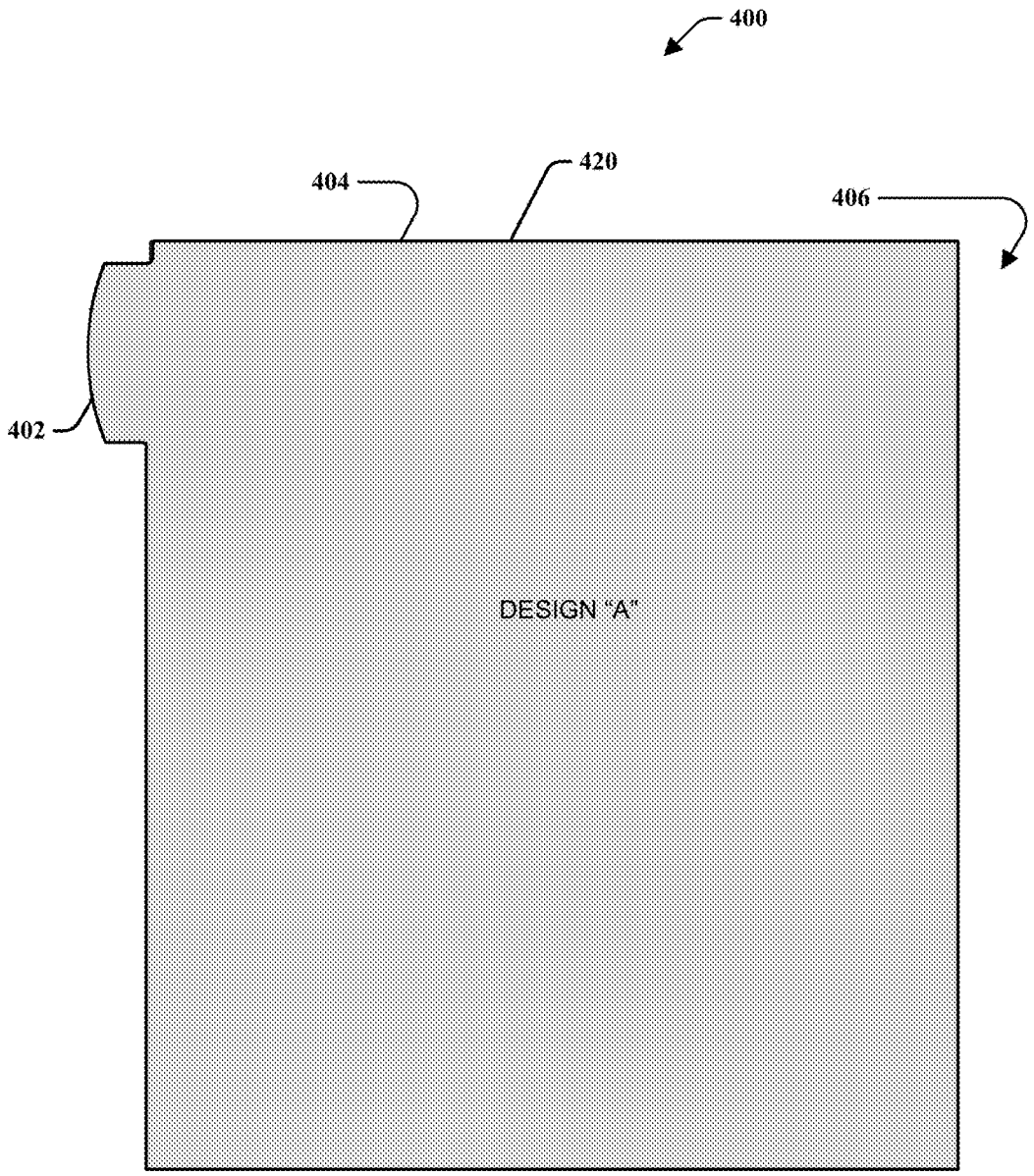
FIG. 5 is a back view of a divider having a graphical design in accordance with an embodiment of the present disclosure.

FIGS. 4-5 depict at least one other embodiment of a divider system. FIG. 4 is a front view of a divider 400 depicting front side 406 in accordance with various disclosed aspects. FIG. 5 is a back view of divider 400 depicting back side 404 in accordance with various disclosed aspects.

In an embodiment, divider 400 may include front side 406 and backside 404. Front side 406 may comprise an exposed portion 422 (e.g., a non-covered portion) and a covered portion 432 covered by the cover material. Exposed portion 422 may comprise an exposed base material that is exposed along a body and a tab 402. Covered portion 432 may comprise a portion of side 406 that is covered by cover material, which does not expose the base material. Rather, cover portion 432 may comprise a portion of side 406 that displays indicia such as DESIGN "A" as illustrated by FIG. 4.

As depicted, cover portion 432 may also comprise information. The information may be a graphical design or other information as described herein. In an aspect, the graphical design may be deposited via a printing means and/or may be formed on a film that is attached to a base material. Additionally, exposed portion 422 may comprise printed indicia such as DESIGN "B" as illustrated by FIG. 4. Here, DESIGN "B" may also cover a side of the tab 402 and is noticeably different than DESIGN "A".

Backside 404 may depict a covered portion 420 that may include the same cover material and indicia as covered portion 432. In at least one other embodiment, covered portions 420 and 432 comprise disparate material and/or designs. It is noted that tab 402 may also be covered by covered portion 420. As depicted, a design or other information may be carried through continuously from covered portion 420 and covered portion 432.

As used herein, the words "example" and "exemplary" means an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, we claim:

1. A divider assembly, comprising:

a body made of an unfolded planar base material, the body having a first side and an opposite second side, the first side comprising a first surface with an exposed portion of the base material and a covered material adjacent an edge of the body, the second side comprising a second surface;

at least one aperture formed within the body adjacent the edge of the body and through said covered material; and said cover material attached to the second side of the body, the cover material covers the entire second surface of the second side and the cover material comprises a first indicia on the second side, wherein the cover material is wrapped from the second side to at least a portion of the first side of the first surface of the body, the cover material on the first surface comprises a second indicia wherein the first indicia covering said second side includes a common continuous design with the second indicia covering said first side.

2. The divider assembly according to claim 1, wherein the exposed portion of the base material includes a third indicia printed thereon different from the second indicia of the cover material.

3. The divider assembly according to claim 1, wherein the cover material is at least one of plastic, metal, foil, coated paper, film, ink, paint, and sprayable material.

4. The divider assembly according to claim 3, wherein the cover material includes pre-printed indicia.

5. The divider assembly according to claim 1, further comprising a tab extending from a perimeter of the body.

6. The divider assembly according to claim 5, wherein the cover material is attached to the second side and covers the entire second surface including the tab.

7. The divider assembly according to claim 1, wherein the base material is at least one of paper, plastic, metal, foil, laminated paper, or coated paper.

8. The divider assembly according to claim 7, further comprising at least one aperture formed within the body.

9. The divider assembly according to claim 7, wherein the exposed portion of the base material includes a third indicia printed thereon different from the first indicia of the cover material.

10. The divider assembly according to claim 7, wherein the cover material is at least one of plastic, metal, foil, coated paper, film, ink, paint, and sprayable material.

11. The divider assembly according to claim 7, further comprising a tab extending from an edge of the body.

12. The divider assembly according to claim 7, wherein the base material is at least one of paper, plastic, metal, foil, laminated paper, or coated paper.

13. The divider assembly according to claim 1, wherein the base material has a first thickness dimension, the cover material has a second thickness dimension, the first thickness dimension is greater than the second thickness dimension.

14. A divider assembly comprising:

a body comprising a base material having a single layer with a first side and a second side, the first side includes an exposed portion of the base material and a covered portion; and a cover material including a first indicia attached to the second side of the body, the cover material covers the entire second side of the body and covering the covered portion of the first side of the body, the cover material is wrapped from the second side to cover an edge of the body and at least a portion of the first side, the covered portion of the first side of the body comprises a second indicia wherein the first indicia covering said second side includes a common continuous design with the second indicia covering said covered portion.

15. A divider assembly, comprising:

a body having a tab extending from a perimeter and made of an unfolded planar base material, the body having a first side and an opposite second side, the first side comprising a first surface with an exposed portion of the base material and a covered portion, the exposed portion displaying a design or indicia, the second side comprising a second surface; and a cover material displaying a design or indicia attached to and covering the base material along the entire second surface of a second side, the cover material covering the covered portion of the base material along the first side adjacent said perimeter opposite from said tab, wherein the design or indicia of the cover material is different from the design or indicia of the exposed portion of the base material; and wherein the exposed portion is compatible to receiving writing from a utensil and the cover material is less compatible to receive writing from a utensil than the exposed portion of the base material.

* * * * *